US006025559A

United States Patent [19]

Simmons

[11] Patent Number: 6,025,559

[45] Date of Patent: Feb. 15, 2000

[54] MOISTURE-RESISTANT SPRING CONNECTOR

[75] Inventor: David O. Simmons, Leander, Tex.

[73] Assignee: Minnesota Mining and Manufacturing Company, Saint Paul, Minn.

[21] Appl. No.: 08/861,137

[22] Filed: May 21, 1997

[51] Int. Cl.[7] ..... H01R 4/22

[52] U.S. Cl. ..... 174/87

[58] Field of Search ..... 174/87; 403/214, 403/268; 203/219, 221

[56] References Cited

U.S. PATENT DOCUMENTS

| | | | |
|---|---|---|---|
| 4,839,473 | 6/1989 | Fox et al. | 174/138 F |
| 5,023,401 | 6/1991 | Clifton | 174/87 |
| 5,023,402 | 6/1991 | King, Jr. et al. | 174/87 |
| 5,107,077 | 4/1992 | Fox et al. | 174/138 F |
| 5,113,037 | 5/1992 | King, Jr. et al. | 174/87 |

FOREIGN PATENT DOCUMENTS

| | | | |
|---|---|---|---|
| 0 432 662 A1 | 6/1991 | European Pat. Off. | H01R 4/22 |

*Primary Examiner*—Kristine Kincaid
*Assistant Examiner*—Chau N. Nguyen
*Attorney, Agent, or Firm*—Matthew B. McNutt

[57] ABSTRACT

A twist-on spring connector includes a multi-piece connector assembly in which a wire or wire bundle is first joined together and subsequently encapsulated into a moisture-resistant sealant. A shell has an open end, a closed end, spaced apart landings including shoulders adjacent the open end and a sealant material in the closed end. A spring holder has sealant passages and spaced apart flanges. The spring holder is mounted in the shell so that the flanges engage the landings. The flanges are limited from movement in a first direction by the shoulders during wire insertion and are movable in a second direction to channels between the landings permitting the spring holder to move toward the closed end of the shell and receive sealant in the sealant passages. An end cap is mounted in the open end of the shell so that the spring holder is retained in the shell and the flanges of the spring holder are movable relative to the landings.

27 Claims, 6 Drawing Sheets

MOISTURE-RESISTANT SPRING CONNECTOR

BACKGROUND

The disclosures herein relate generally to a twist-on spring connector for engaging stranded or solid wire together and more particularly to a multi-piece connector assembly in which a wire bundle has its junction ends first joined together and subsequently encapsulated into a moisture-resistant sealant.

In some situations, it is especially important to protect wire connections from moisture and other contamination. Sealants have been used to seal the wires and/or the twist-on spring connector, commonly referred to as a spring connector, so that the contaminants are restricted from contacting the electrical connection. Sealing compounds used may be either hardening or non-hardening materials. The purpose of the sealing compound is to create a waterproof or water-resistant encapsulation over the wire connector and the joined ends of the electrical wires.

One known application provides a wire connector with a sleeve rotatably mounted in the end thereof with the sleeve containing sealant to permit the user to insert the twisted junction ends of electrical leads into the wire connector by inserting the junction ends into the sealant located in the sleeve and the connector. The user then holds the wire and sleeve and rotates the connector to simultaneously form the junction ends of the electrical leads into a low resistance electrical connection protected by the sealant.

Another application provides a wire connector with an end cap to hold a sealant in the wire connector. The user inserts the twisted wires through the end cap into the sealant in the connector. While holding the wires, the user twists the wire connector to simultaneously form an electrical connection between the wires and to place a waterproof and spark inhibiting coating over the twisted electrical leads to produce a waterproof and fire retardant connection.

A problem associated with the above-mentioned connectors is that in some instances, the junction ends of the wires do not properly seat within the connector and must be removed and re-twisted. Also, the user often tugs on the wire bundle to test for proper wire seating which sometimes dislodges an improperly engaged wire from the connector. In either situation, if the wires are removed, they withdraw the sealant coating with them. This reduces the sealant remaining in the connector and creates voids and air pockets in the sealant material. As a result, when the wires are re-inserted, the air pockets and voids create possible areas for moisture and other contaminants to collect, thus defeating the intended purpose of the sealant compound.

Therefore, what is needed is a connector for joining wire ends together and sealing the connections from moisture and other contaminants, in which a wire bundle has its junction ends first joined together in a manner which can be checked and tested for proper connection and then can be subsequently encapsulated in a moisture resistant sealing compound.

SUMMARY

One embodiment accordingly, provides a multi-piece connector assembly in which a wire bundle is first joined together and subsequently encapsulated into a moisture-resistant sealant. To this end, a connector includes a shell having an open end and a sealant receiving closed end. Wire receiving means are releasably mounted in the shell adjacent the open end for receiving and securing at least one wire therein, for being released from the open end and for being moved with the at least one wire therein to a position within the closed end.

A principal advantage of this embodiment is that the shell can contain a sealant at the closed end at a level whereby the sealant does not encapsulate wire receiving means and wires while positioned at the open end of the shell. Once the wires are connected, secured and tested, the wire receiving means can be released from the open end and can be moved toward the closed end of the shell, whereby the wires and the wire receiving means are encapsulated by the sealant.

DETAILED DESCRIPTION OF THE PREFERRED EMBODIMENT

Figure 1:
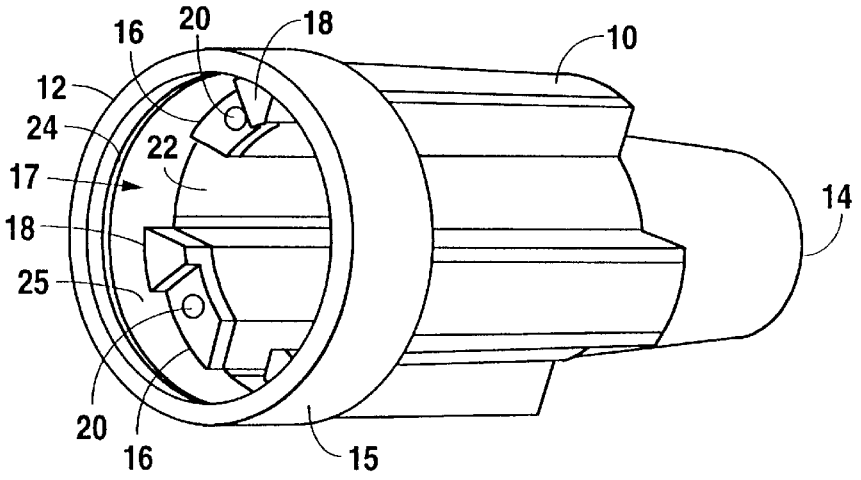
FIG. 1 is an isometric view illustrating an embodiment of a spring connector shell.

Referring to FIG. 1, a twist-on spring connector includes a generally elongated shell designated 10 having an open end 12, a closed end 14 and an annular wall 15 defining a closed end cavity 17 therein, a plurality of spaced apart landings 16 including shoulders 18 and protruding anti-rotational detents 20. Landings 16 are adjacent open end 12 and are each spaced apart by an elongated channel 22 which extends from open end 12 toward closed end 14. A sealant material, not shown in FIG. 1, but discussed below, is provided in closed end 14 of shell 10. Open end 12 is preferably annular and includes an internal annular groove 24 formed in an inner surface 25 of wall 15.

Figure 2:
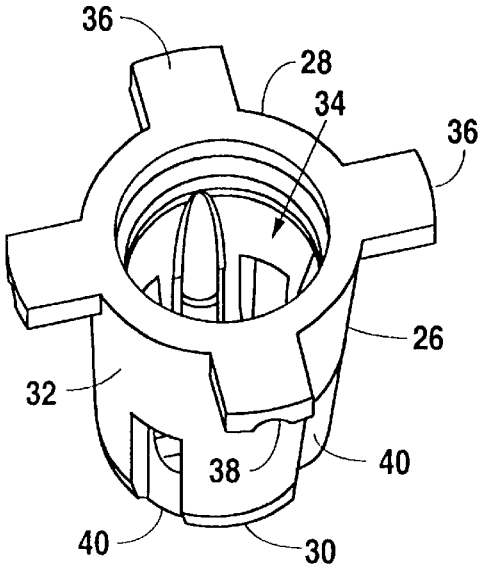
FIG. 2 is an isometric view illustrating an embodiment of a spring holder.
Figure 3:
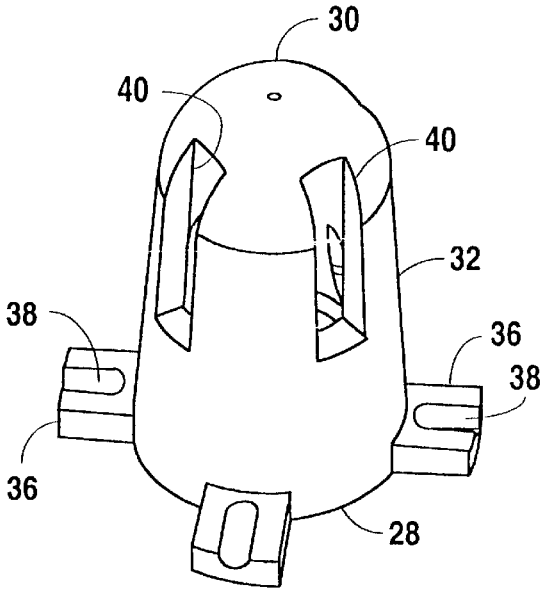
FIG. 3 is an isometric view illustrating an inverted embodiment of the spring holder of FIG. 2.
Figure 4:
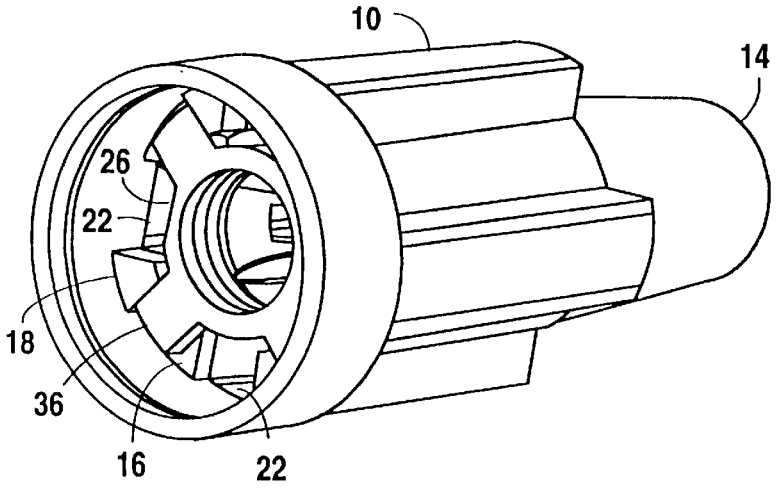
FIG. 4 is an isometric view illustrating an embodiment of a spring connector shell including a spring holder lodged therein.
Figure 5:
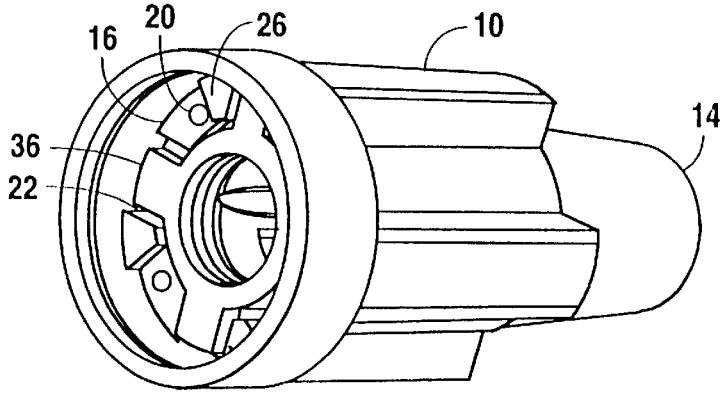
FIG. 5 is another isometric view illustrating an embodiment of a spring connector shell including a spring holder lodged therein.

A spring holder 26, FIGS. 2 and 3, is generally elongated and has an open end 28, a closed end 30 and an annular wall 32 defining a closed end cavity 34 therein, a plurality of spaced apart flanges 36 including recesses 38, for receiving detents 20 of shell 10, and a plurality of sealant passages 40 formed in annular wall 32. Flanges 36 are adjacent open end 28 and are spaced apart to correspond to the spacing of landings 16 of shell 10. Spring holder 26 is sized to fit within shell 10, FIG. 4, so that flanges 36 engage landings 16. Shoulders 18 block rotation of flanges 36 in a clockwise direction relative to landings 16, as viewed in FIG. 4. However, flanges 36 are retarded from inadvertently rotating in a counter-clockwise direction as viewed in FIG. 4 by anti-rotational detents 20 engaged with recesses 38 as discussed above. However, detents 20 may be forcibly dislodged from recesses 38 so that flanges 36 disengage from landings 16, whereupon flanges 36 may be rotated counter-clockwise and positioned to engage channels 22, FIG. 5. Spring holder 26 is shorter in length than shell 10. Therefore, when flanges 36 engage channels 22, spring holder 26 may be moved toward closed end 14 of shell 10.

Figure 6:
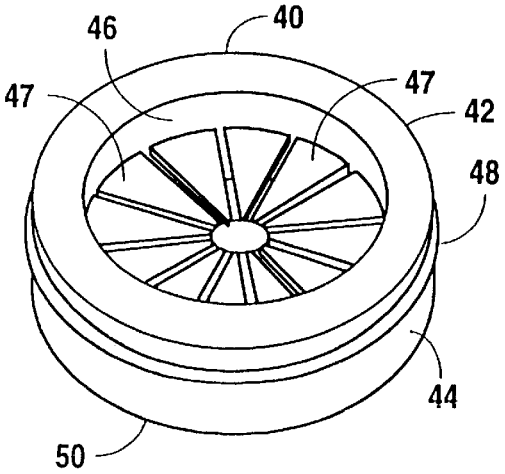
FIG. 6 is an isometric view illustrating an embodiment of an end cap.
Figure 7:
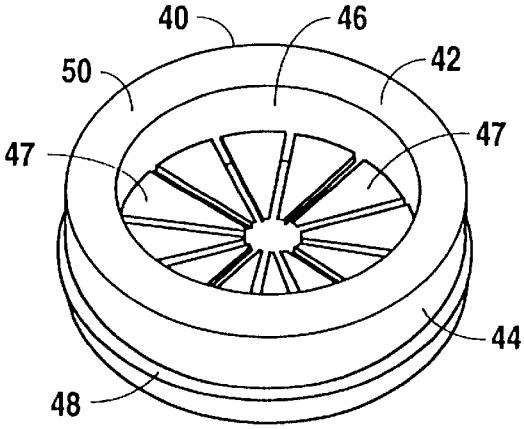
FIG. 7 is an isometric view illustrating an inverted embodiment of the end cap of FIG. 6.
Figure 8:
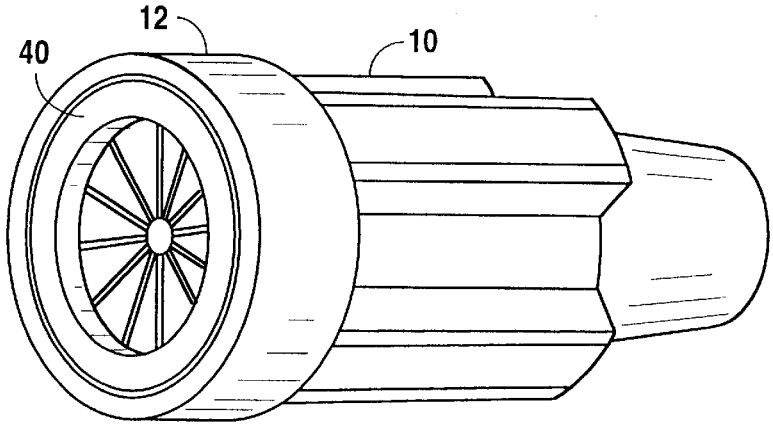
FIG. 8 is an isometric view illustrating an embodiment of a spring connector shell including an end cap mounted therein.

An end cap 40, FIGS. 6 and 7, is generally annular and includes an annular wall 42 having an outer annular surface 44 and an inner annular surface 46. A ridge 48 is formed to protrude from outer annular surface 44 and engage annular groove 24 of shell 10 when cap 40 is inserted in open end 12 of shell 10, FIG. 8. Annular wall 42 is provided with a length such that when cap 40 is inserted in shell 10, FIG. 8, an end surface 50, FIG. 7, of annular wall 42 maintains flanges 36 engaged with landings 16 but does not interfere with the rotation of flanges 36 on landings 16 as described above. A plurality of flexible, radially inwardly directed fingers 47 are attached to inner annular surface 46 of end cap 40.

Figure 9:
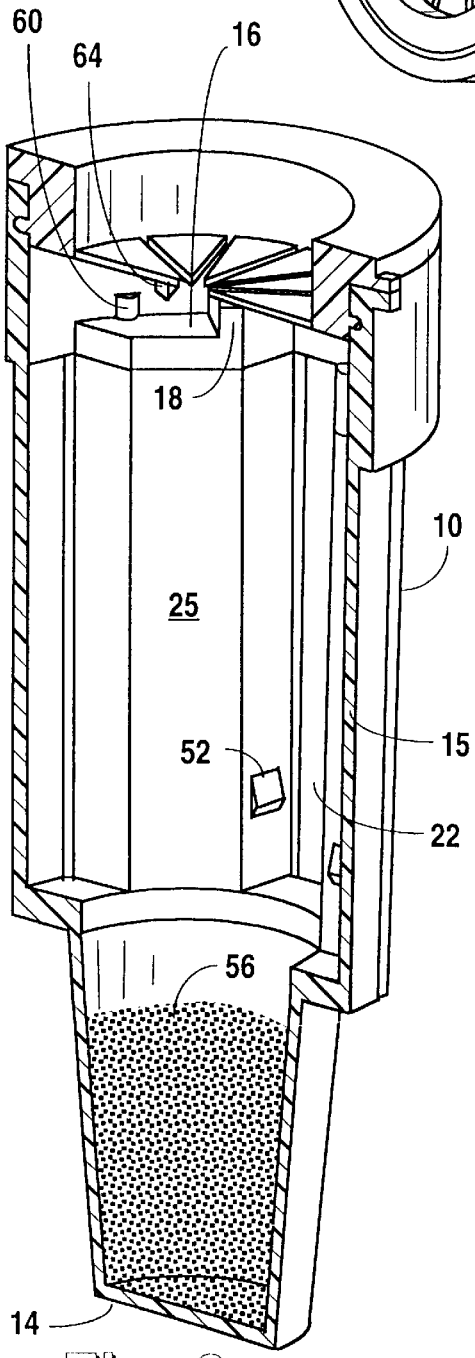
FIG. 9 is an isometric view illustrating an embodiment of a spring connector shell having a portion cut-away.
Figure 10:
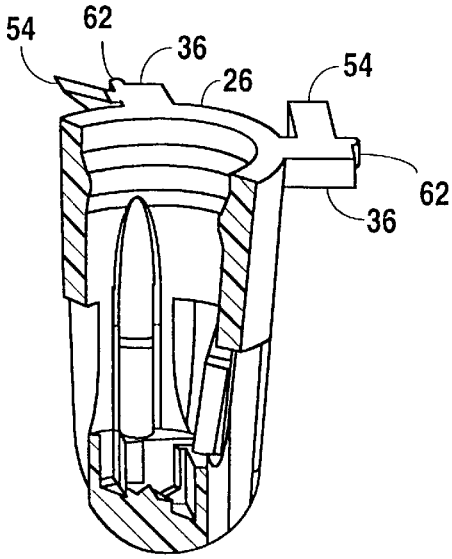
FIG. 10 is an isometric view illustrating an embodiment of a spring holder having a portion cut-away.
Figure 11:
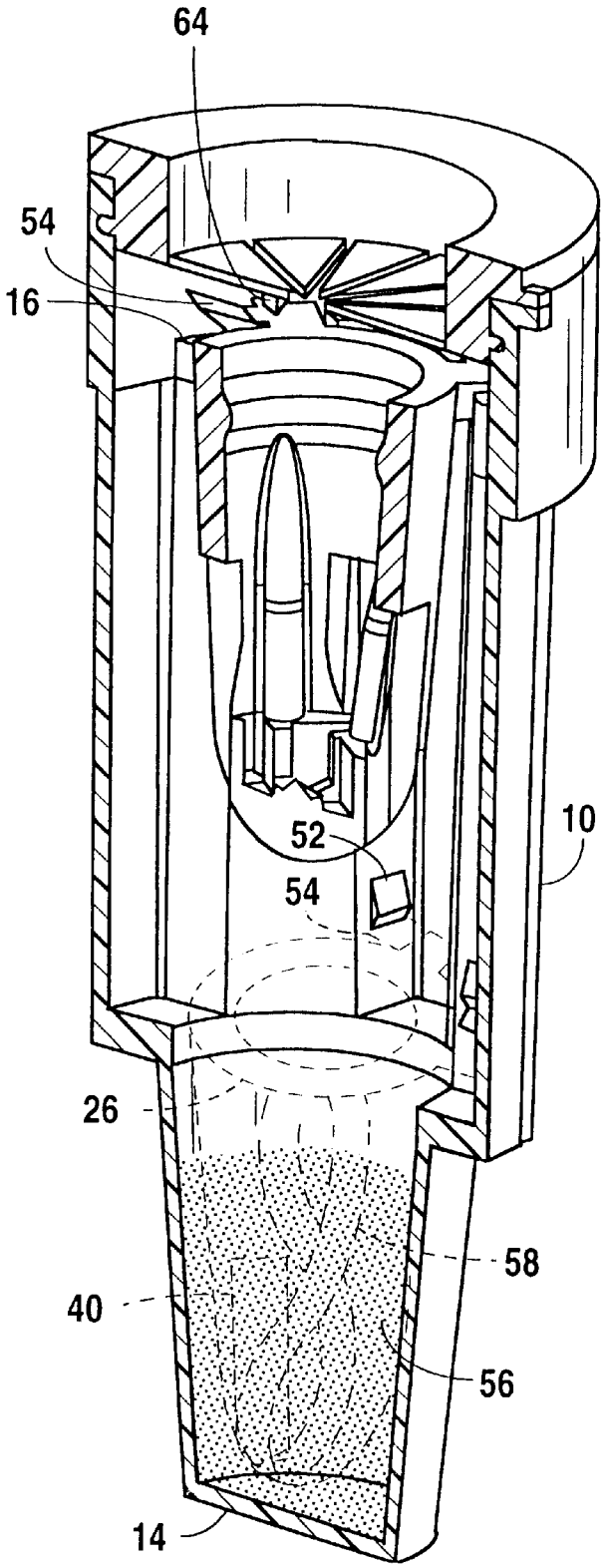
FIG. 11 is an isometric view illustrating an embodiment of a spring connector shell and a spring holder mounted therein having portions cut-away.

In another embodiment, FIG. 9, shell 10 includes means such as tabs 52 protruding from internal surface 25 of wall 15 adjacent closed end 14 for retaining the spring holder 26 adjacent the closed end 14 of the shell 10 which contains a sealant compound 56. This is accomplished by wings 54, FIG. 10 formed on and extending from flanges 36 of spring holder 26 which engage tabs 52 when spring holder 26 is moved along channel 22 toward closed end 14 of shell 10. In this manner, FIG. 11, after spring holder 26 is moved toward closed end 14 of shell 10, sealant compound 56 in closed end 14, passes into spring holder 26 via the sealant passage 40 and encapsulates a pair of twisted wire ends 58 secured within spring holder 26. As discussed above, wings 54 engage tabs 52 to retain spring holder 26 at closed end 14 of shell 10.

Figure 12:
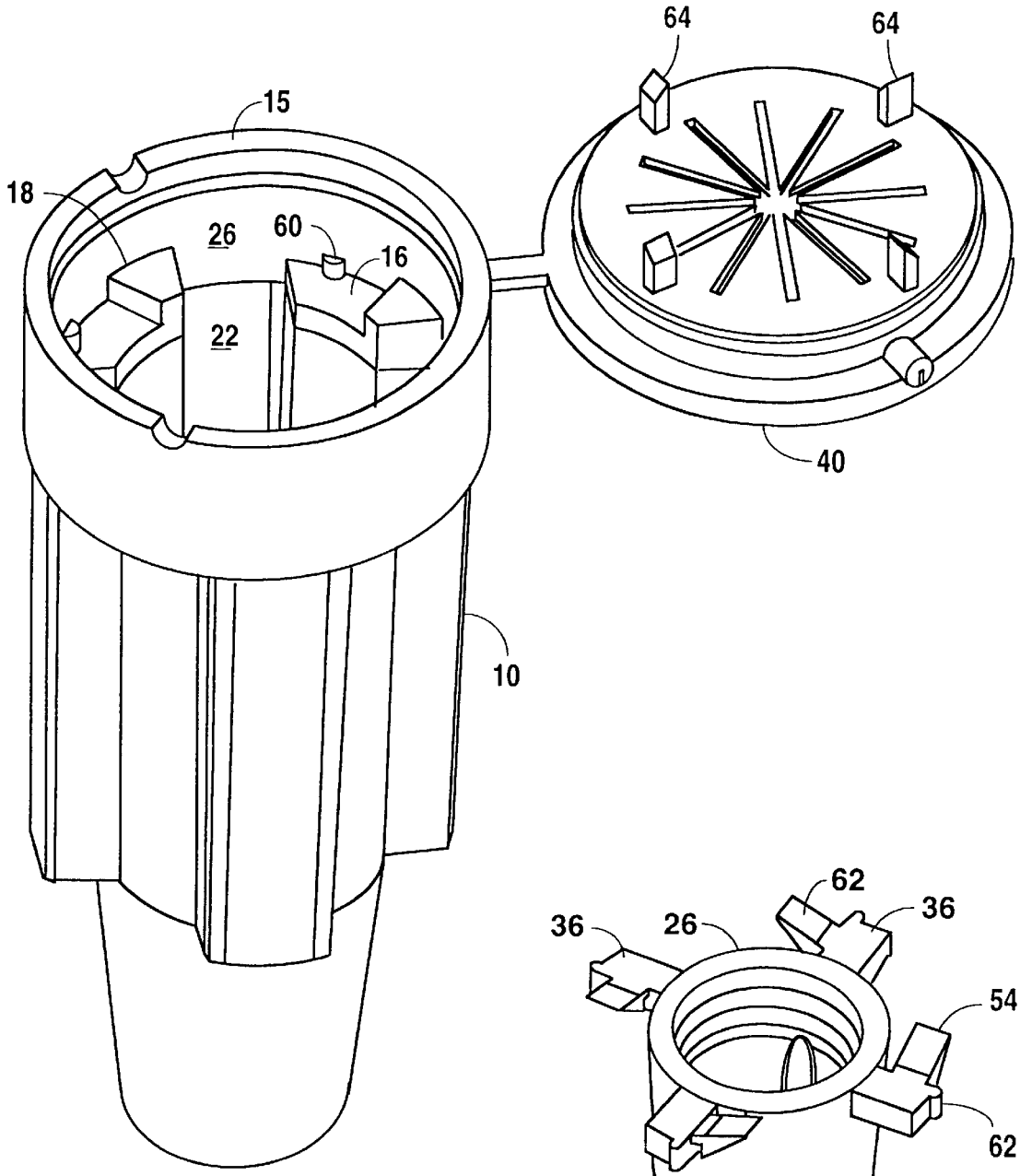
FIG. 12 is an isometric view illustrating an embodiment of a spring connector shell and end cap.
Figure 13:
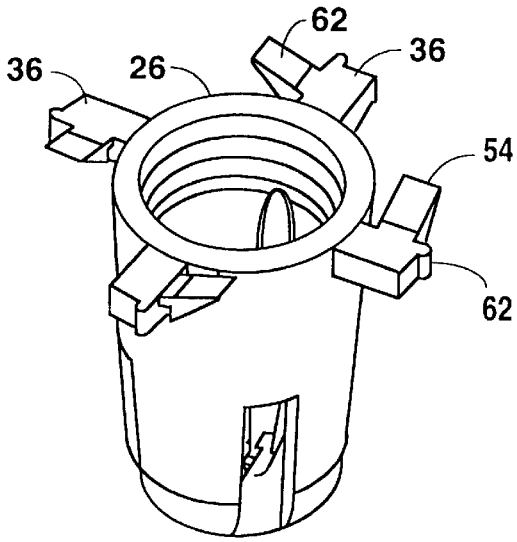
FIG. 13 is an isometric view illustrating an embodiment of a spring holder.

As an alternative to the anti-rotational detents 20 of landings 16 which are received by the recesses 38 in flanges 36, a plurality of anti-rotational tabs 60, FIG. 12, may be provided on surface 26 of wall 15 and on landings 16. These tabs 60 are engaged by tabs 62, FIG. 13, formed on flanges 36 to retard inadvertent counter-clockwise rotation of spring holder 26. Shoulders 18 completely block clockwise rotation of flanges 36. In addition, a plurality of flexible legs 64, FIG. 12, extend from end cap 40. Legs 64 engage flanges 36 for maintaining flanges 36 in engagement with landings 16 but do not interfere with the rotation of flanges 36 on landing 16 as described above. This is similar to the description above regarding end surface 50, FIG. 7, of annular wall 42 on end cap 40. In this embodiment however, in order to dislodge tabs 60 and 62, FIGS. 12, 13, flanges 36 may be drawn toward end cap 40 which flexes legs 64 sufficiently to permit tabs 62 to be moved out of engagement with tabs 60 thus permitting flanges 36 to be rotated counter-clockwise and positioned in channels 22.

Figure 14:
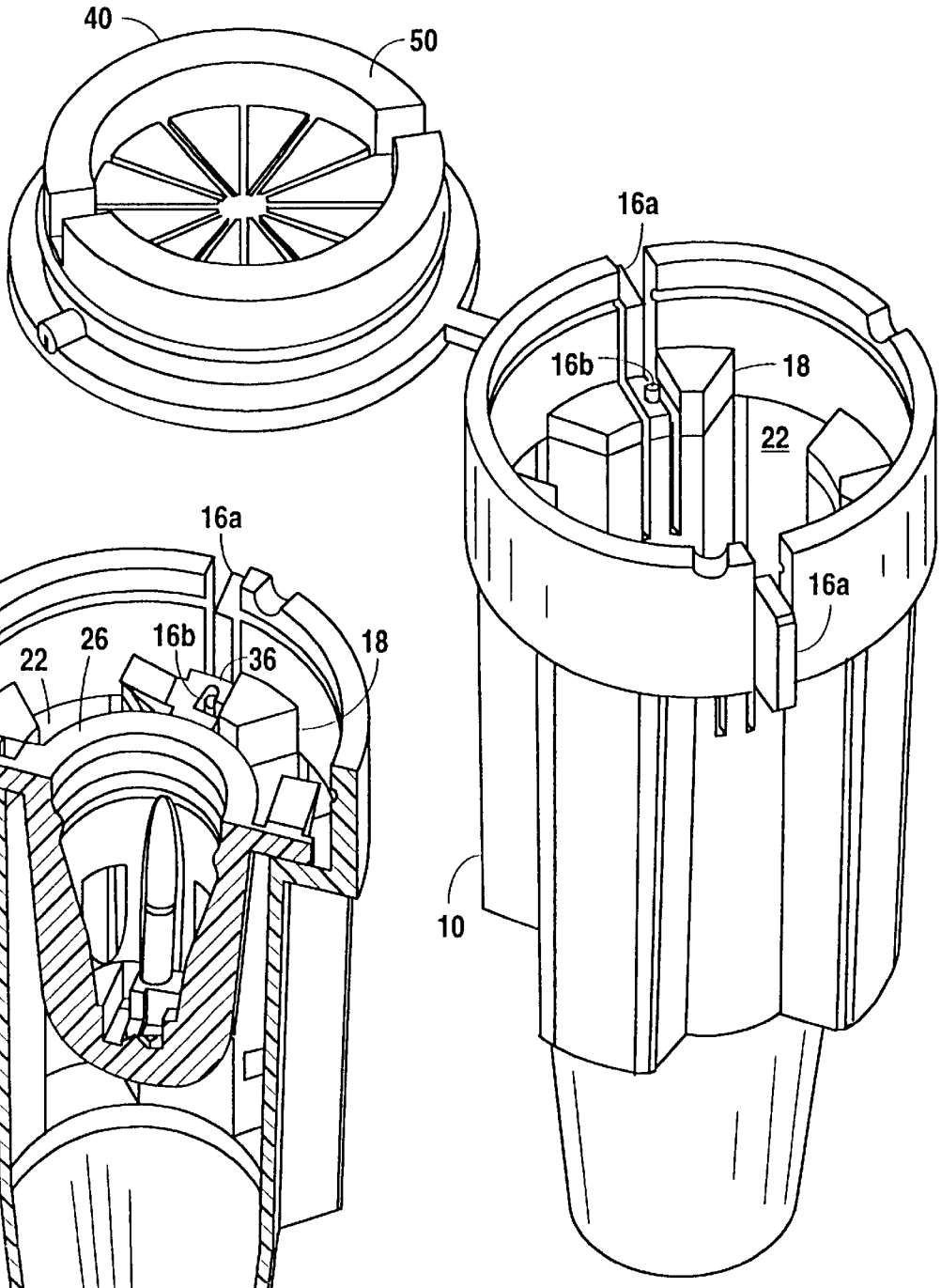
FIG. 14 is an isometric view illustrating an embodiment of a spring connector shell and end cap.
Figure 15:
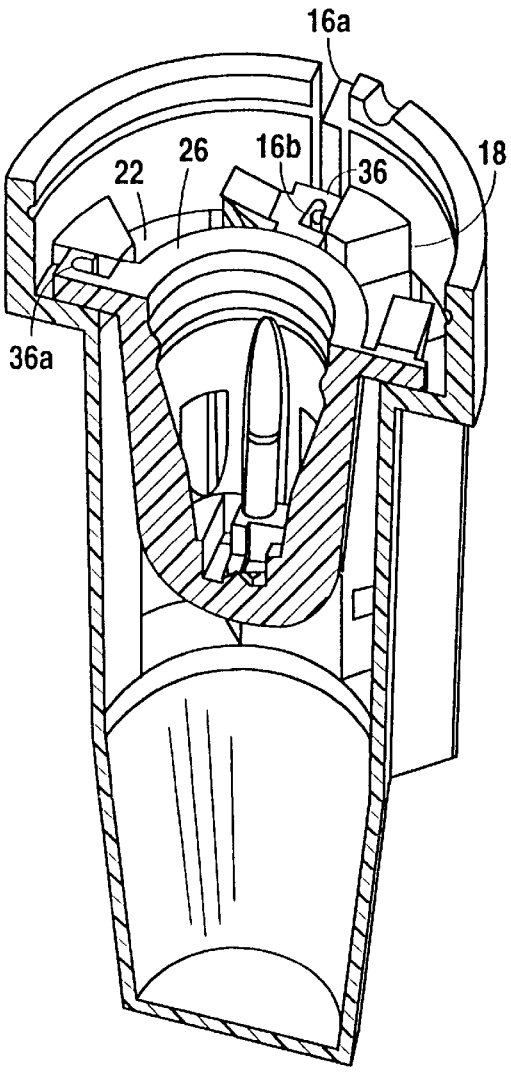
FIG. 15 is an isometric view illustrating an embodiment of a spring connector shell having a spring holder mounted therein with portions cut-away.

In a preferred embodiment however, shell 10, FIG. 14, includes flexible landing portions 16*a* having anti-rotational tabs 16*b* extending therefrom to retard inadvertent counter-clockwise rotation of flanges 36 while shoulders 18 completely block clockwise rotation of flanges 36. Flanges 36 of spring holder 26 have j-shaped slots 36*a*, FIG. 15, formed therein which engage anti-rotational tabs 16*b*. In addition, end surface 50, FIG. 14, of end cap 40, maintains flanges 36 engaged with landings 16 but does not interfere with the rotation of flanges 36 on landings 16. In this embodiment, in order to dislodge tabs 16*b* from slots 36*a*, flexible landing portions 16*a* are flexed inwardly to a position permitting tabs 16*b* to exit slots 36*a* thus permitting flanges 36 to be rotated counter-clockwise and positioned in channels 22.

In operation, wires may be pre-twisted together and inserted through the end cap and into the spring holder which is seated on the landings in the shell. Clockwise twisting of the wires relative to the shell secures the wires in the spring holder. During the clockwise twisting of the wires, the spring holder is blocked from clockwise rotation by the engagement of the flanges and shoulders, and limited from inadvertent counter-clockwise rotation by one of the abovedescribed detent devices. Testing of the wires for secure engagement is possible by applying a tensile force to the wires. The spring holder is maintained against withdrawal from the shell by engagement with the end cap. After the wires are tested for secure engagement with the spring holder, the spring holder may be rotated counter-clockwise to overcome the anti-rotational detent devices as described above to position the flanges in the channels. The spring holder can then be moved toward the closed end of the shell and secured to remain at the closed end of the shell by the tabs which engage the flange wings. The sealant material enters the spring holder via the sealant passages and the secured wire ends and spring holder are encapsulated in the sealant material at the closed end of the shell, thus forming a moisture and contaminant resistant spring connector.

As it can be seen, the principal advantages of these embodiments are that the invention includes a moisture-proof spring connector for connecting stranded and solid wire. The uses for such a connector include applications were moisture is a concern such as irrigation systems and landscape lighting, industrial equipment where contamination from surrounding operations may result in corrosion at the connection, and other similar types of applications. The connector is of a unitary design and has an encapsulated electrical connection, yet allows the connection to be made prior to the moisture sealant coming in contact with the spring or the wire.

This connector is suited for use in all types of commercial, residential and industrial applications. Specifically, it can be used in outdoor lighting, automotive and marine applications, landscape/irrigation applications, industrial equipment and any other applications where moisture and contamination are a concern. The preferred voltage range rating for this connector is up to 1000 V.

This connector provides the following key benefits and advantages over other moisture-proof or moisture-resistant spring connectors: fewer faulty connections because the connection is visible; unitary or pre-assembled design for ease of handling/installation; allows for the entire circuit to be tested without disturbing the sealant; air is not entrapped in the sealant by the twisting of the connector during connection of the wires; less time/money spent fixing connections since connector can be removed without cutting wires; the connector can be removed without disturbing the sealant if the connection or circuit is incorrect; the sealant and design protect against dielectric failures; comparable manufacturing cost to other types of similar connectors; wide wire range with unsurpassed reliability over the range; excellent stranded wire performance; and fast installation speed.

The connector generally consists of a shell having an opening at one end and being closed at the other end, a spring holder having a helical, tapered coil spring pressed or welded into it and an end plug which retains the spring holder within the shell. The shell is configured to position and maintain the spring holder adjacent to the open end of the shell while the connector is being twisted onto the wires. The shell is filled with a sealant to a level whereby sealant does not enter the spring holder so long as the spring holder is positioned at the open end of the shell. Once the wires are connected, the spring holder can be released from the open end of the shell and inserted into the closed end, thereby encapsulating the spring holder and connected wire bundle into the sealant.

The spring holder is formed from a polymeric material such as polypropylene or polyethylene or could also be formed from metal. Since the spring holder is fully encapsulated in the sealant during normal operation, the spring holder need not be formed of a non-conductive and non-corrosive material. However, it is preferable that the spring holder be formed from a non-conductive and non-corrosive material.

The spring holder includes a hollow portion for receiving the spring and flanges for engaging the landings in the shell. The hollow portion may include ribs, an undercut, or kick-out grooves similar to those in non-sealed spring connectors, if necessary to provide the desired electrical and mechanical performance. The walls of the cavity of the spring holder have passages which allow sealant to enter the spring holder as it is being pushed into the closed end of the shell. The flanges may include recesses for engaging detents on the mating surface of the shell landings for preventing the spring holder from unintentionally releasing from the open end of the shell during shipping and handling.

The shell is an elongated tube with an open and closed end. Due to environmental and performance requirements, the shell is preferably formed from a polymeric material such as polypropylene or polyethylene. Strength, dielectric resistivity, moisture absorption, and UV resistance are key selection criteria for the shell material. The overall design of the shell as well as the design elements that interact with the flanges of the spring holder prevent the spring holder from unintentionally being inserted into the sealant and prevent the spring holder from rotating relative to the shell as the connector is being twisted onto the wires.

During shipping and installation, the spring holder rests atop the landings of the shell. To ensure that the spring holder does not unintentionally fall into the sealant during shipping and handling, detents on top of the landings engage the recesses in the mating surface of the spring holder flanges to provide a slight, but sufficient, force resisting rotation. When the connection to the wires is being made, the torsional force from the hand is applied to the outer surface of the shell and is transmitted to the spring holder via the flanges of the spring holder engaging the shoulders of the shell and resisting the applied torsional forces.

Once the electrical connection is made, the shell is twisted in the opposite direction to disengage the spring holder from the detents of the shell. This aligns the flanges with channels between the landings, enabling the spring holder (spring and wires included) to be pushed towards the closed end of the shell.

An end cap formed from a polymeric material is located in the open end of the shell. The end cap includes a ridge that engages a groove in the shell to retain the end cap and an annular surface or flexible legs portion that hold the spring holder against the landings. The length of the annular portion (or legs) is dimensioned to allow the spring holder to turn freely such that it can be disengaged from the detents and pressed into the sealant. The end cap may also include a series of radially inwardly directed, flexible finger-like projections that prevent the sealant from being disturbed following insertion of the spring holder into the sealant and to provide an adequate level of strain relief to the wires.

A number of alternate embodiments for the connector are possible. The end cap can be formed from an elastomeric material such as those sold under the names Santoprene or Elexar so that the finger-like projections are exceptionally resilient; the shell can include internal geometry which prevents the spring holder from being withdrawn once is pushed into the closed end of the shell; the sealant can be a two part epoxy-like compound that uses the displacement of the spring holder to mix the two parts of the compound and induce hardening; the shell can include well-known wings portions for reducing fatigue in the fingers; the clearance between the spring holder and the shell can be optimized for "by-passing" different viscosity sealants; and the sealant can be air or moisture cured such that it forms a membrane on the exposed surfaces of the sealant (this membrane would be broken by the spring holder upon entry and a new membrane would subsequently be formed).

Although illustrative embodiments have been shown an described, a wide-range of modifications, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A spring connector comprising:

a shell having an open end, a sealant receiving closed end containing a sealant and a landing adjacent the open end;

a wire receiving spring holder mounted within the shell adjacent the open end of the shell and limited from movement in a direction toward the open end of the shell, the spring holder having a sealant passage and a flange, the spring holder being separated from the sealant, and mounted in the shell so that the flange is in engagement with the landing and is movable to disengage the landing, permitting the spring holder to move toward the closed end of the shell and into the sealant; and an end cap mounted in the open end of the shell so that the spring holder is retained in the shell and the flange of the spring holder is movable relative to the landing of the shell.

2. The spring connector as defined in claim 1 wherein the open end is annular and includes an internal annular groove.

3. The spring connector as defined in claim 2 wherein the end cap includes an annular ridge for engagement with the internal annular groove.

4. The spring connector as defined in claim 3 wherein the end cap includes a plurality of radially inwardly directed fingers.

5. The spring connector as defined in claim 1 wherein the landing includes a detent and a shoulder.

6. The spring connector as defined in claim 5 wherein the flange of the spring holder includes a recess to engage the detent on the landing.

7. The spring connector as defined in claim 6 wherein the flange is rotatably engaged with the landing.

8. The spring connector as defined in claim 7 wherein the flange is blocked from rotation in a first direction by the shoulder and is free to rotate in a second direction to disengage the landing.

9. The spring connector as defined in claim 1 wherein in response to the spring holder moving toward the closed end of the shell, the sealant communicates into the spring holder through the sealant passage.

10. The spring connector as defined in claim 1 wherein the end cap includes terminating means adjacent the flange for maintaining the flange in engagement with the landing.

11. The spring connector as defined in claim 1 wherein the shell includes means for retaining the spring holder adjacent the closed end of the shell.

12. A twist-on spring connector comprising:

a shell having an open end, a closed end, spaced apart landings including shoulders adjacent the open end and a sealant material in the closed end;

a spring holder having sealant passages and spaced apart flanges, the spring holder being mounted in the shell so that each of the flanges engages a respective one of the landings, the flanges being limited from movement in a first direction by the shoulders during wire insertion and movable in a second direction to channels between the landings permitting the spring holder to move toward the closed end of the shell and receive sealant in the sealant passages; and an end cap mounted in the open end of the shell so that the spring holder is retained in the shell and the flanges of the spring holder are movable relative to the landings.

13. The twist-on spring connector as defined in claim 12 wherein the end cap includes means terminating adjacent the flanges for maintaining the flange in engagement with the landing.

14. The twist-on spring connector as defined in claim 12 wherein the shell and the flanges include means for retaining the spring holder adjacent the closed end of the shell.

15. The twist-on spring connector as defined in claim 12 wherein the open end is annular and includes an internal annular groove.

16. The twist-on spring connector as defined in claim 15 wherein the end cap includes an annular ridge for engagement with the internal annular groove.

17. The twist-on spring connector as defined in claim 16 wherein the end cap includes a plurality of radially inwardly directed fingers.

18. The twist-on spring connector as defined in claim 12 wherein each of the landings include a detent.

19. The twist-on spring connector as defined in claim 18 wherein each of said flanges of the spring holder includes a recess to engage the detents on each respective landing.

20. The twist-on spring connector as defined in claim 19 wherein each of said flanges is rotatably engaged with each respective landing.

21. The twist-on spring connector as defined in claim 20 wherein each of said flanges is blocked from rotation in the first direction by a respective shoulder and is free to rotate in the second direction to disengage the landings.

22. The twist-on spring connector as defined in claim 12 wherein the spring holder is in positive locked engagement with the landings requiring manual release prior to being moved toward the closed end of the shell to receive the sealant material.

23. A spring connector comprising:

a shell having an open end and a sealant receiving closed end containing a sealant; and wire receiving means releasably mounted in the shell adjacent the open end and separated from the sealant, the wire receiving means adapted for receiving at least one wire therein, the wire receiving means configured to be released from the open end and moved with the at least one wire therein into the sealant to a position within the closed end.

24. The spring connector as defined in claim 23 wherein the wire receiving means is in a positive locked engagement with the open end of the shell requiring manual release prior to being moved toward the closed end of the shell.

25. The spring connector as defined in claim 23 wherein the shell includes spaced apart landings and the wire receiving means includes spaced apart flanges engaging the landings.

26. The spring connector as defined in claim 25 wherein the flanges of the wire receiving means are in positive locked engagement with the landings of the shell requiring manual release prior to being moved toward the end of the shell.

27. The spring connector as defined in claim 23 wherein the shell includes an end cap mounted in the open end.

* * * * *